US008139016B2

(12) United States Patent
Yi

(10) Patent No.: US 8,139,016 B2
(45) Date of Patent: Mar. 20, 2012

(54) METHOD FOR IMPROVING THE EMI PERFORMANCE OF AN LCD DEVICE

(75) Inventor: Chien-Yu Yi, Hsin-Chu (TW)

(73) Assignee: AU Optronics Corp., Hsin-Chi (TW)

( * ) Notice: Subject to any disclaimer, the term of this patent is extended or adjusted under 35 U.S.C. 154(b) by 1127 days.

(21) Appl. No.: 12/000,694

(22) Filed: Dec. 17, 2007

(65) Prior Publication Data

US 2008/0252623 A1 Oct. 16, 2008

(30) Foreign Application Priority Data

Apr. 13, 2007 (TW) ..... 096113064

(51) Int. Cl.
*G09G 3/36* (2006.01)

(52) U.S. Cl. ..... 345/100; 345/98; 345/99; 345/213

(58) Field of Classification Search ..... 345/98, 345/99, 100, 213
See application file for complete search history.

(56) References Cited

U.S. PATENT DOCUMENTS 6,340,970 B1 * 1/2002 Furuhashi et al. ..... 345/213
6,867,759 B1 * 3/2005 Baek et al. ..... 345/99
2001/0022571 A1 * 9/2001 Nakano et al. ..... 345/98
* cited by examiner

*Primary Examiner* — Richard Hjerpe
*Assistant Examiner* — Saifeldin Elnafia
(74) *Attorney, Agent, or Firm* — Bacon&Thomas, PLLC

(57) ABSTRACT

A method for improving the EMI performance of an LCD device is disclosed, adapting for a point-to-point transistor transistor logic interface of the LCD device. The disclosed method comprises the following steps: receiving a plurality of image data based on a data CLK signal; providing a first CLK signal and a second CLK signal to a plurality of source drivers by a timing controller, wherein the frequencies of the first CLK signal and the second CLK signal are smaller than the frequency of the data CLK signal, the phase of the first CLK signal is different from the phase of the second CLK signal; and the timing controller transmitting a plurality of first image data to the plurality of source drivers based on the first CLK signal, and the timing controller transmitting a plurality of second image data to the plurality of source drivers based on the second CLK signal.

16 Claims, 8 Drawing Sheets

METHOD FOR IMPROVING THE EMI PERFORMANCE OF AN LCD DEVICE

BACKGROUND OF THE INVENTION

1. Field of the Invention

The present invention relates to the LCD device technical field and, more particularly, to a method for improving the EMI performance of an LCD device.

2. Description of Related Art

In general, since the transistor transistor logic (TTL) interface, located between the timing controller and the source drivers of an LCD device, requires a lot of data buses to transmit image data, a serious electric power consumption and a severe Electro-Magnetic Interfering (EMI) performance are experienced at the TTL interface.

FIG. 1 is a block diagram showing the conventional timing controller having a TTL transmission interface. In order to improve the power consumption and the EMI problem occurring between the timing controller 1 and the source driver, the timing controller shown in FIG. 1 employs a Dual Port transmission method to transmit the image data to the source drivers. If the resolution of the display gray level is 8 bits, then 48 data bus lines are required (8 bit×3 RGB×2 Dual port=48). Besides, for corresponding with the two sets of input LVDS signal, the output terminal of the timing controller 1 further comprises two data bus lines, i.e. the EDTA [47:0] and ODTA [47:0].

FIG. 2 is a block diagram showing the conventional timing controller having a PPTTL transmission interface, which can solve the problem of too many data bus lines shown in FIG. 1. In FIG. 2, the timing controller 2 employs a Point-to-Point transmission method to transmit the image data to the source drivers. If the display panel module uses 10 source drivers, then only 30 data bus lines are required (10 source driver ICs×3 RGB=30). Moreover, by employing the Point-to-Point transmission method, the number of the data bus lines required is no longer related to the resolution of the display gray level (6 bits or 8 bits). Therefore, in display system having higher resolution, the advantage of the Point-to-Point transmission method, relative to the Dual Port transmission method, is more obvious. Nevertheless, for a large-sized display panel, the distortion of the image data, caused by the PPTTL interface employed the Point-to-Point transmission method is more significant.

FIG. 3 is a schematic view showing the conventional panel module employing the dual port transmission method. In FIG. 3, the display panel 3 is divided into a first display portion 31 and a second display portion 32. The timing controller (not shown) transmits the image data to the source drivers (not shown) by employing the dual port transmission method. The source drivers (not shown) then transmit the image data to the first display portion 31 and the second display portion 32 (i.e. two-way transmission), respectively. Therefore, by lowering the CLK signal operating frequency, the electric power consumption and the EMI performance can be improved.

FIG. 4 is a timing diagram of the conventional dual port transmission method. In FIG. 4, the dual port transmission method using a CLK signal to control the transmission of two image data, i.e. the first sampling waveform controls the transmission of the image data A and the image data B. As a result, by employing the dual port transmission method, the number of the CLK signals required for displaying image can be reduced by half. However, as the size of the display panels gets bigger and bigger, and as the resolution of the display panels have increased significantly, the number of the CLK signals has also increased a lot. As a result, even by employing the dual port transmission method, the electric power consumption and the EMI performance still cannot be improved.

Therefore, it is desirable to provide a method for improving the EMI performance of an LCD device to mitigate and/or obviate the aforementioned problems.

SUMMARY OF THE INVENTION

The object of the present invention is to provide a method for improving the EMI performance of an LCD device, in order to improve the electric power consumption and the EMI performance thereof.

According to one aspect of the present invention, the method for improving the EMI performance of an LCD device comprises the following steps: (a) receiving a plurality of image data based on a data CLK signal; (b) providing a first CLK signal and a second CLK signal, wherein the frequency of the first CLK signal and the frequency of the second CLK signal are smaller than the frequency of the data CLK signal, the phase of the first CLK signal is different from the phase of the second CLK signal; and (c) transmitting a plurality of first image data based on the first CLK signal, and transmitting a plurality of second image data based on the second CLK signal.

According to another aspect of the present invention, the method for improving the EMI performance of an LCD device, and adapted for an LCD device, comprises the following steps: (a) receiving a plurality of image data based on a data CLK signal; (b) providing a first CLK signal and a second CLK signal to a plurality of source drivers by a timing controller, wherein the frequency of the first CLK signal and the frequency of the second CLK signal are smaller than the frequency of the data CLK signal, the phase of the first CLK signal is different from the phase of the second CLK signal; and (c) the timing controller transmitting a plurality of first image data to the plurality of source drivers based on the first CLK signal, and the timing controller transmitting a plurality of second image data to the plurality of source drivers based on the second CLK signal.

In one embodiment of the present invention, while in step (c), the timing controller transmits a plurality of third image data to the plurality of source drivers based on the first CLK signal, wherein the phase of the plurality of first image data is different from the phase of the plurality of third image data. Besides, in another embodiment of the present invention, the timing controller transmits a plurality of fourth image data to the plurality of source drivers based on the second CLK signal, wherein the phase of the plurality of second image data is different from the phase of the plurality of fourth image data.

In another embodiment of the present invention, while in step (b), the timing controller further provides a third CLK signal and a fourth CLK signal, wherein the frequency of the third CLK signal and the frequency of the fourth CLK signal are smaller than the frequency of the data CLK signal. Besides, the phase of the first CLK signal, the phase of the second CLK signal, the phase of the third CLK signal, and the phase of the fourth CLK signal are different from each other. In still another embodiment of the present invention, while in step (c), the timing controller transmits a plurality of fifth image data based on the third CLK signal, and the timing controller transmits a plurality of sixth image data based on the fourth CLK signal.

According to still another aspect of the present invention, the timing controller adapted for an LCD panel module and electrically connected with a plurality of source drivers, comprises: a receiving unit, receiving a plurality of image data based on a data CLK signal; a data processing logic unit, electrically connected with the receiving unit and the plurality of source drivers; and a multi-phase CLK signal generating unit, electrically connected with the receiving unit and the data processing logic unit, wherein the multi-phase CLK signal generating unit provides a first CLK signal and a second CLK signal, the frequency of the first CLK signal and the frequency of the second CLK signal are smaller than the frequency of the data CLK signal, and the phase of the first CLK signal is different from the phase of the second CLK signal. Besides, the data processing logic unit transmits a plurality of first image data to the plurality of source drivers based on the first CLK signal, and the data processing logic unit transmits a plurality of second image data to the plurality of source drivers based on the second CLK signal.

In one embodiment of the present invention, the data processing logic unit transmits a plurality of third image data to the plurality of source drivers based on the first CLK signal, wherein the phase of the plurality of first image data is different from the phase of the plurality of third image data. In another embodiment of the present invention, the data processing logic unit transmits a plurality of fourth image data to the plurality of source drivers based on the second CLK signal, wherein the phase of the plurality of second image data is different from the phase of the plurality of fourth image data.

In another embodiment of the present invention, the multi-phase CLK signal generating unit further provides a third CLK signal and a fourth CLK signal, wherein the frequency of the third CLK signal and the frequency of the fourth CLK signal are smaller than the frequency of the data CLK signal. Besides, the phase of the first CLK signal, the phase of the second CLK signal, the phase of the third CLK signal, and the phase of the fourth CLK signal are different from each other.

In still another embodiment of the present invention, the data processing logic unit transmits a plurality of fifth image data based on the third CLK signal. Besides, the data processing logic unit transmits a plurality of sixth image data based on the fourth CLK signal.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
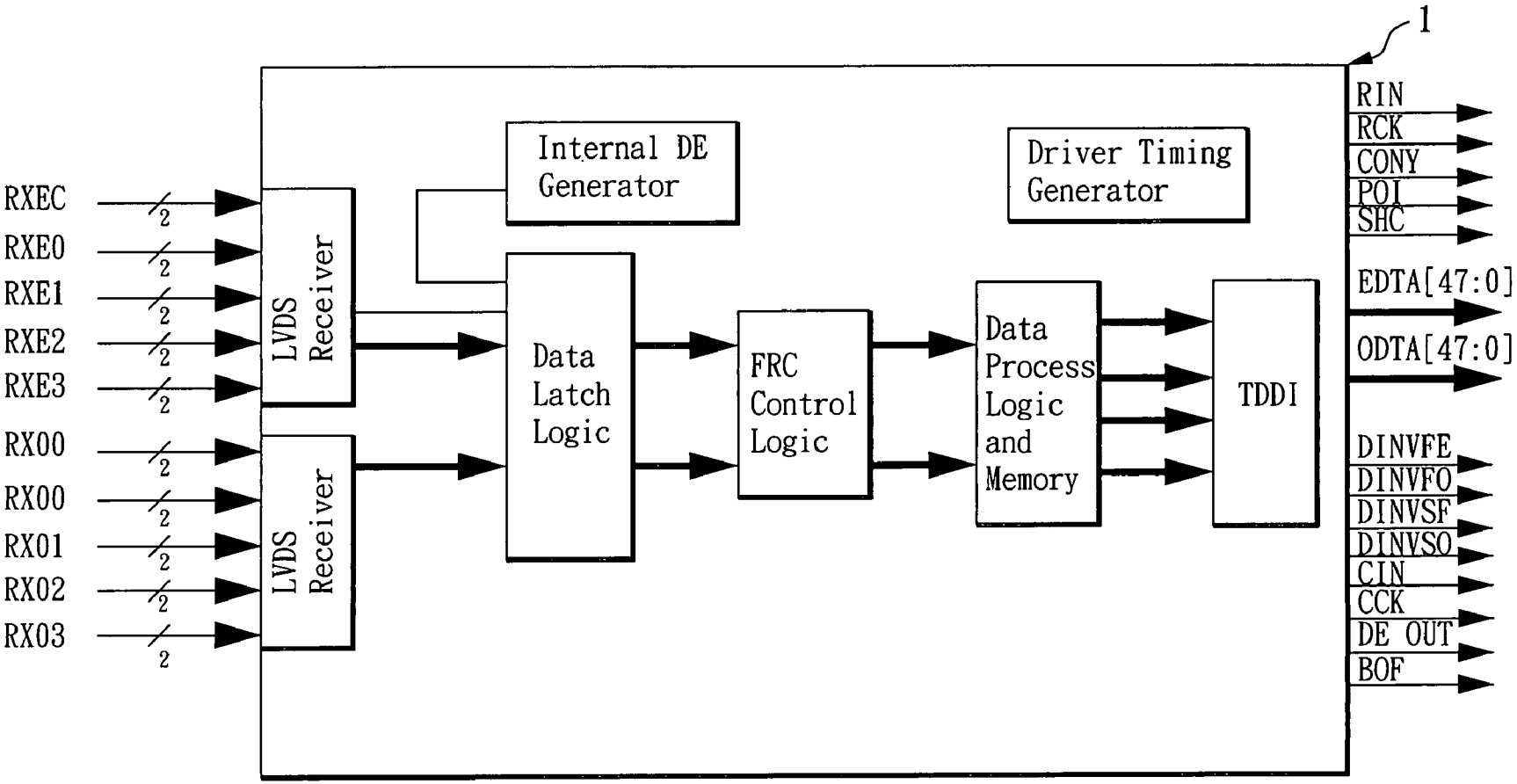
FIG. 1 (PRIOR ART)
FIG. 1 is a block diagram showing the conventional timing controller having a TTL transmission interface.
Figure 2:
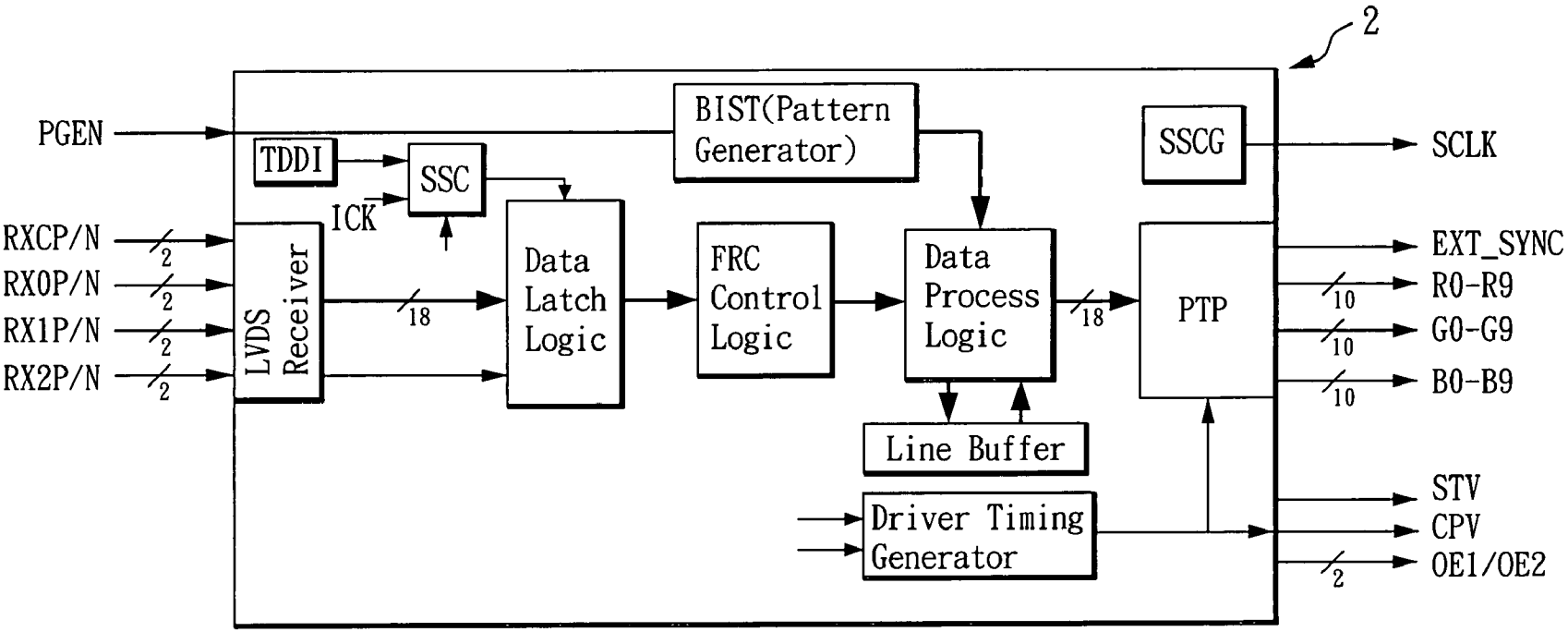
FIG. 2 (PRIOR ART)
FIG. 2 is a block diagram showing the conventional timing controller having a PPTTL transmission interface.
Figure 3:
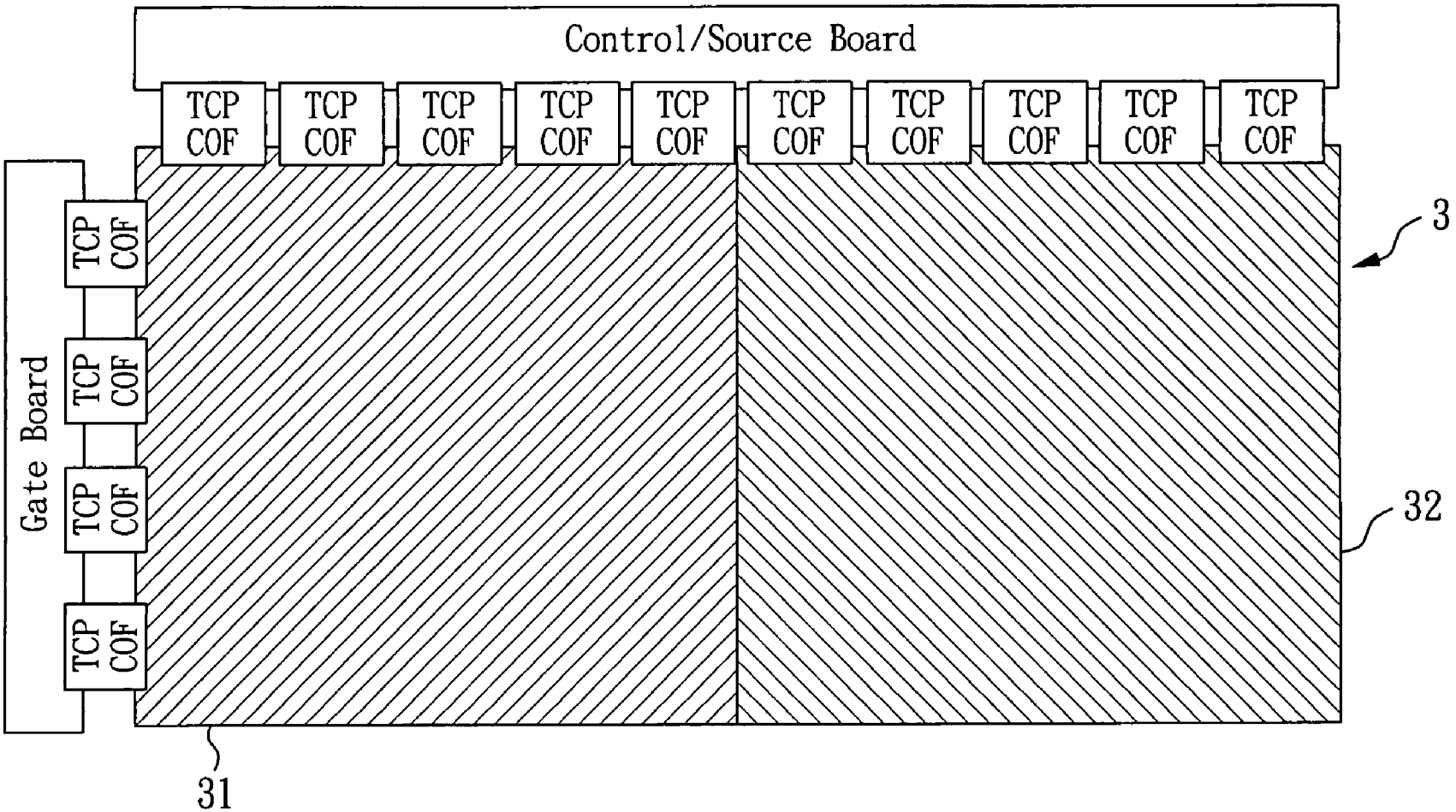
FIG. 3 (PRIOR ART)
FIG. 3 is a schematic view showing the conventional panel module employing the dual port transmission method.
Figure 4:
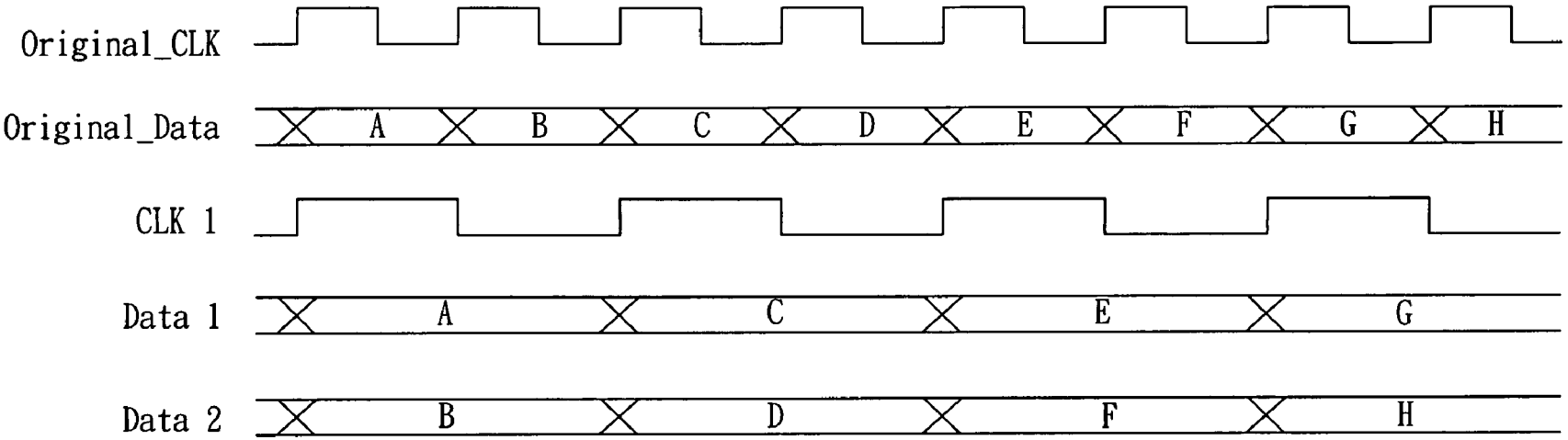
FIG. 4 (PRIOR ART)
FIG. 4 is a timing diagram of the conventional dual port transmission method.
Figure 5A:
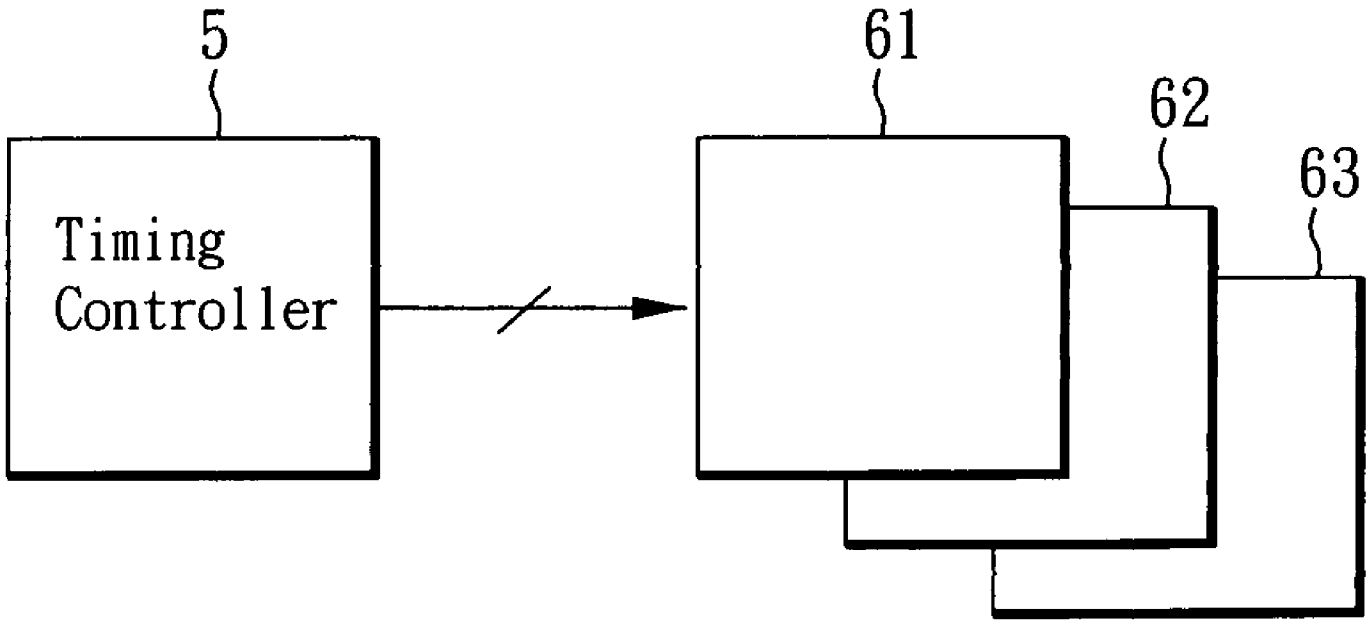
FIG. 5*a* is a block diagram according to the first embodiment of the present invention.

With reference to FIG. 5*a*, the preferred embodiment of the present invention will be described. In the figure, a timing controller 5, and a plurality of source drivers 61, 62, 63 are shown. Besides, the timing controller 5 is electrically connected with the plurality of source drivers 61, 62, 63.

Figure 5B:
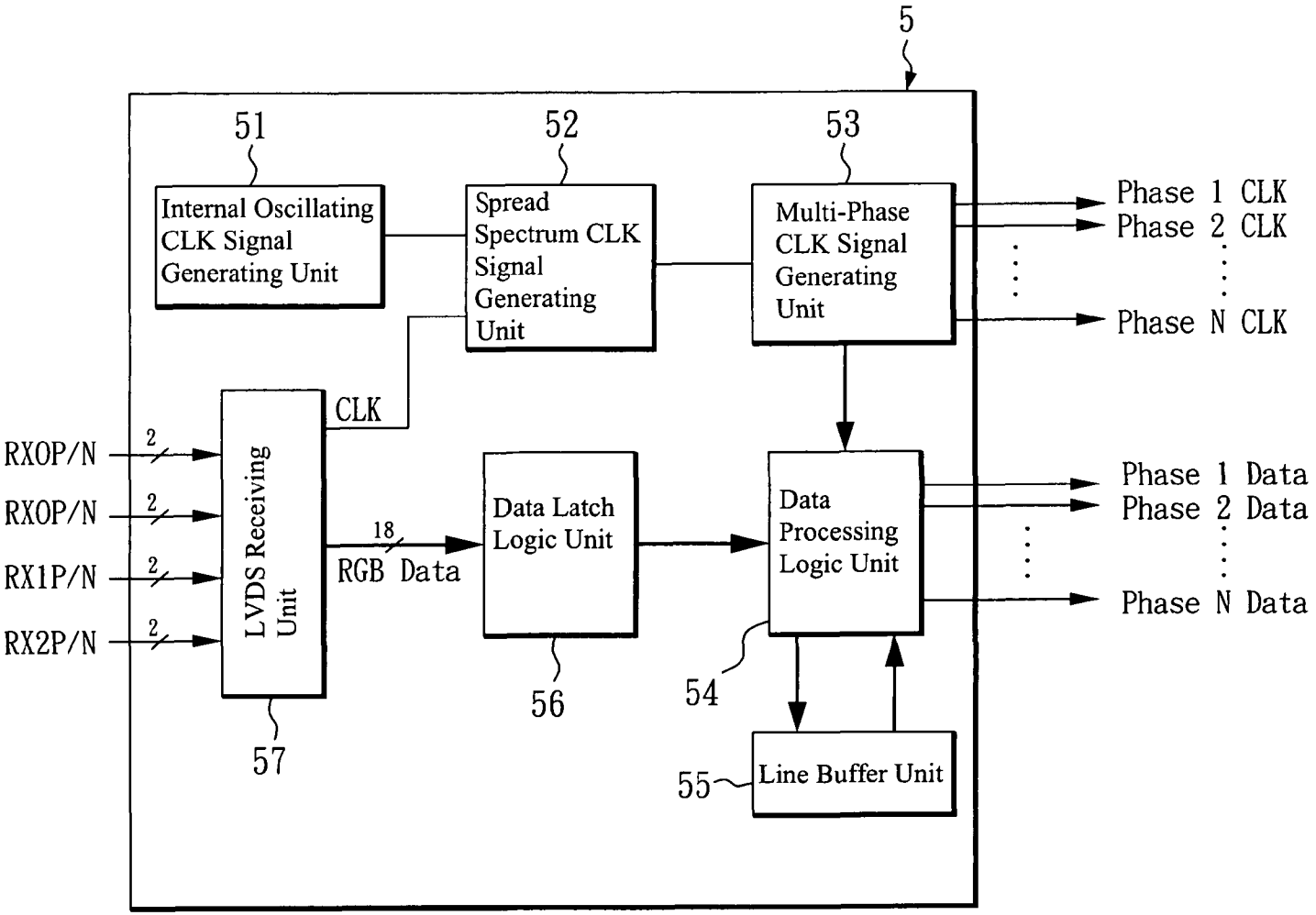
FIG. 5*b* is a block diagram of the timing controller, according to the first embodiment of the present invention.

FIG. 5*b* is a block diagram of the timing controller 5. As shown in the figure, the timing controller 5 comprises: an internal oscillating CLK signal generating unit 51, a spread spectrum CLK signal generating unit 52, a multi-phase CLK signal generating unit 53, a data processing logic unit 54, a line buffer unit 55, a data latch logic unit 56, and an LVDS receiving unit 57.

The internal oscillating CLK signal generating unit 51 and the LVDS receiving unit 57 are electrically connected with the spread spectrum CLK signal generating unit 52. The LVDS receiving unit 57 is electrically connected with the data latch logic unit 56. The spread spectrum CLK signal generating unit 52 is electrically connected with the multi-phase CLK signal generating unit 53. The multi-phase CLK signal generating unit 53 and the data latch logic unit 56 are electrically connected with the data processing logic unit 54. The data processing logic unit 54 is electrically connected with the line buffer unit 55. Moreover, the multi-phase CLK signal generating unit 53 and the data processing logic unit 54 are electrically connected with the plurality of source drivers 61, 62, 63, respectively.

The aforementioned LVDS receiving unit 57 receives a data CLK signal, and the LVDS receiving unit 57 then receives a plurality of image data (RGB data) based on the data CLK signal. The image data is then transmitted to the data latch logic unit 56 and registered at the data latch logic unit 56. The data CLK signal is transmitted to the spread spectrum CLK signal generating unit 52. In the present invention, the spread spectrum CLK signal generating unit 52 includes a delay locked loop (not shown). In more detailed description, the delay locked loop is a PPL delay locked loop, which controls a delay circuit (not shown), in order to compare the CLK signals having different phase with the data CLK signal, and makes the CLK signals become synchronized with the data CLK signal. Later, the synchronized CLK signals are transmitted to the multi-phase CLK signal generating unit 53, which generates a plurality of CLK signals having different phase to the plurality of source drives 61, 62, 63, based on the synchronized CLK signals. The data processing logic unit 54 transmits a plurality of image data to the plurality of source drives 61, 62, 63, based on the synchronized CLK signals having different phase and received from the multi-phase CLK signal generating unit 53.

Figure 6:
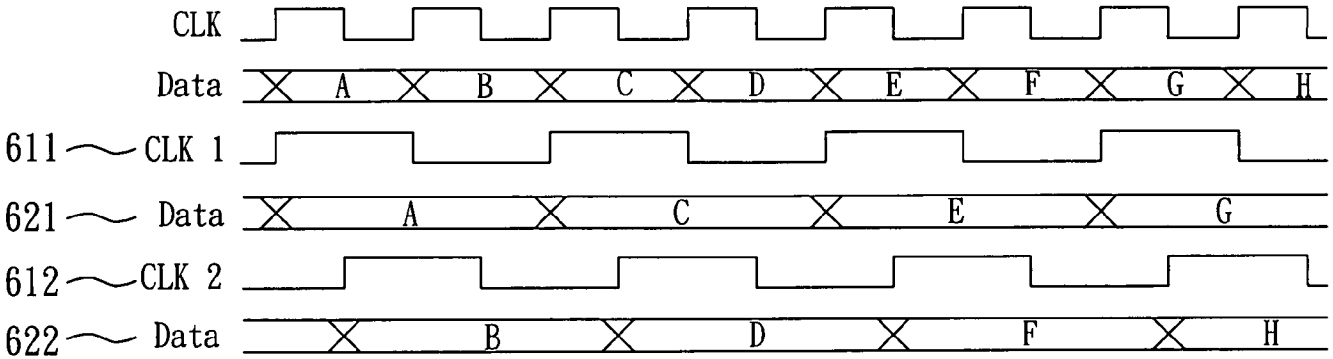
FIG. 6 is a timing diagram according to the first embodiment of the present invention.

Please refer to FIG. 6, which is a timing diagram according to the first embodiment of the present invention, along with the above description regarding FIG. 5*a* and FIG. 5*b*.

In FIG. 6, the LVDS receiving unit 57 of the timing controller 5 receives a plurality of image data, base on a plurality of CLK signals. The multi-phase CLK signal generating unit 53 transmits CLK signals 611, 612 to the plurality of source drivers 61, 62, 63. Besides, the data processing logic unit 54 transmits image data 621, 622 to the plurality of source drivers 61, 62, 63. The frequencies of the CLK signal 611 and the CLK signal 612 are smaller than the frequency of the data CLK signal, and the phase of the CLK signal 611 is different from the phase of the CLK signal 612. That is, the phase of the CLK signal 611 and the phase of the CLK signal 612 are different from each other, by employing the phase biasing method on the timing controller 5. As shown in FIG. 6, the phase difference between CLK signals 611 and 612 is greater than zero degrees but less than 180 degrees.

If the phase of the CLK signal 611 is same with the phase of the CLK signal 612, the EMI waveform produced at the upper end and the lower end of each CLK signal waveform will accumulate with each other. That is, during the switch between the waveform of the CLK signal 611 and the waveform of the CLK signal 612, the EMI energy is accumulated since the CLK signal 611 is affected by the noise produced by the CLK signal 612. In same manner, the EMI energy is accumulated since the CLK signal 612 is affected by the noise produced by the CLK signal 611 during the switch. Therefore, the EMI performance is deteriorated. To solve the above problem, the timing controller 5 of the present invention provides CLK signals 611, 612 having different phase to minimize the accumulation of the EMI energy and to improve the EMI performance. Besides, the timing controller 5 transmits the image data 621 to the plurality of source drivers 61, 62, 63 based on the CLK signal 611, and transmits the image data 622 to the plurality of source drivers 61, 62, 63 based on the CLK signal 612. It should be noted that, since the phase of the CLK signal 611 is different from the phase of the CLK signal 612, the phase of the image data 621 is different from the phase of the image data 622. As a result, by dispersing the EMI energy, the consumption of electric power and the EMI performance is thus improved.

Figure 7:
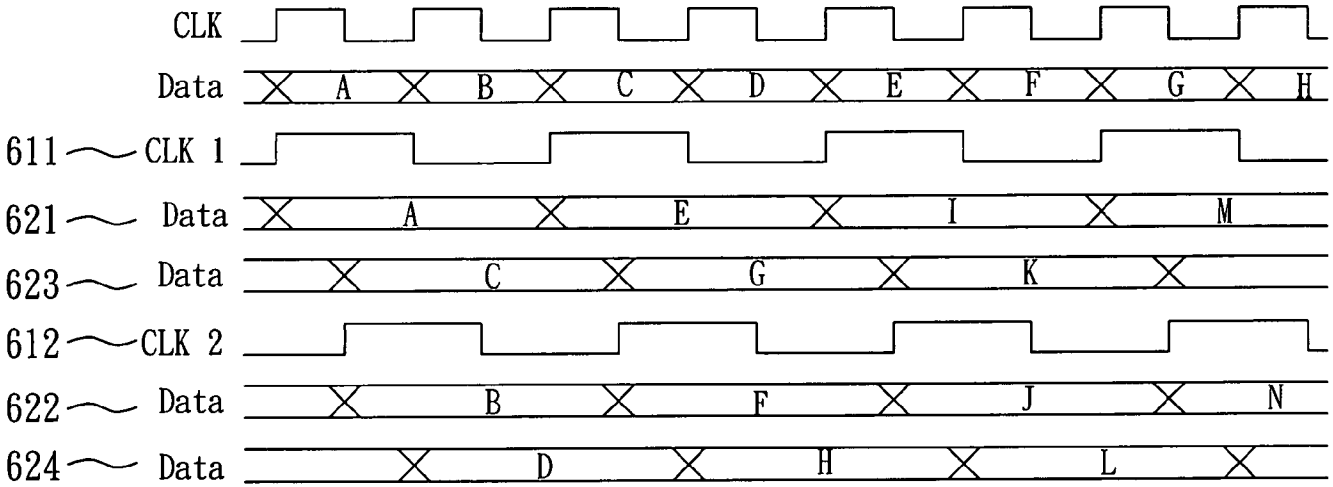
FIG. 7 is a timing diagram according to the second embodiment of the present invention.

FIG. 7 is a timing diagram according to the second embodiment of the present invention, and is to be referred to with the above description regarding FIG. 5*a* and FIG. 5*b*.

The operation of the second embodiment of the present invention is similar to that of the first embodiment of the present invention. The multi-phase CLK signal generating unit 53 of the timing controller 5 provides the CLK signal 611 and the CLK signal 612, while the data processing logic unit 54 transmits image data 621, 622, 623, 624 to the plurality of source drives 61, 62, 63. Besides, the phase of the image data 621 is different from the phase of the image data 623. The phase of the image data 622 is different from the phase of the image data 624.

Therefore, the timing controller 5 can transmit image data 621, 623 to the plurality of source drivers 61, 62, 63 based on the CLK signal 611, and transmit image data 622, 624 to the plurality of source drivers 61, 62, 63 based on the CLK signal 612, in order to improve the consumption of electric power and the EMI performance.

Figure 8:
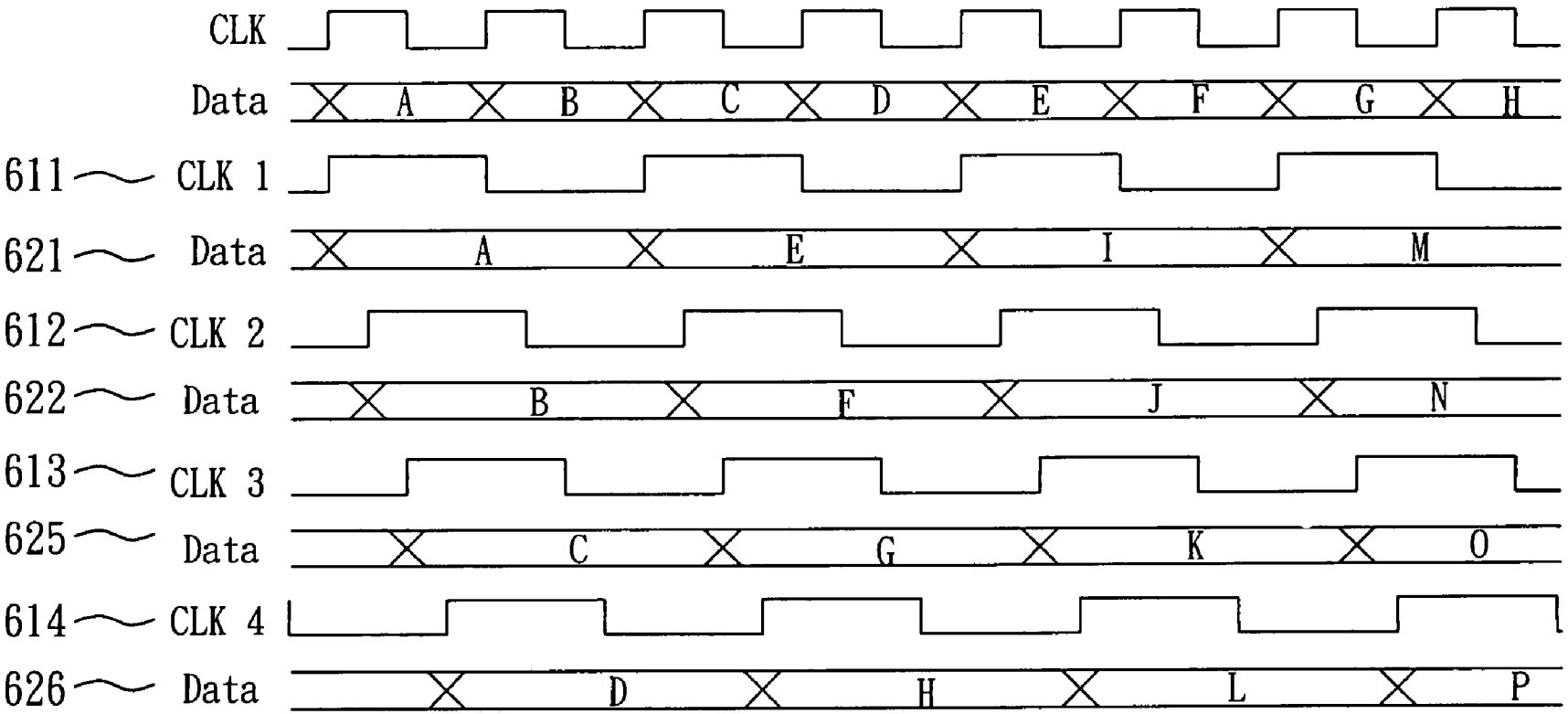
FIG. 8 is a timing diagram according to the third embodiment of the present invention.

FIG. 8 is a timing diagram according to the third embodiment of the present invention, and is to be referred to with the above description regarding FIG. 5*a* and FIG. 5*b*.

The operation of the third embodiment of the present invention is similar to that of the first embodiment of the present invention. The multi-phase CLK signal generating unit 53 of the timing controller 5 provides a plurality of CLK signals 611, 612, 613, 614, while the data processing logic unit 54 transmits image data 621, 622, 625, 626 to the plurality of source drives 61, 62, 63. Besides, the frequencies of the plurality of CLK signals 611, 612, 613, 614 are smaller than the frequency of the data CLK signal. Moreover, the phase of the CLK signals 611, the phase of the CLK signals 612, the phase of the CLK signals 613, and the phase of the CLK signals 614 are different from each other.

Therefore, the timing controller 5 can transmit image data 621 to the plurality of source drivers 61, 62, 63 based on the CLK signal 611, transmit image data 622 to the plurality of source drivers 61, 62, 63 based on the CLK signal 612, transmit image data 625 to the plurality of source drivers 61, 62, 63 based on the CLK signal 613, and transmit image data 626 to the plurality of source drivers 61, 62, 63 based on the CLK signal 614, in order to improve the consumption of electric power and the EMI performance.

As described above, by changing the phase relation of the CLK signals and the data image, the method and the timing controller claimed in the present invention can improve the consumption of electric power and the EMI performance.

Although the present invention has been explained in relation to its preferred embodiment, it is to be understood that many other possible modifications and variations can be made without departing from the scope of the invention as hereinafter claimed.

What is claimed is:

1. A method for improving the EMI performance of an LCD device, adapting for a point-to-point transistor transistor logic interface of the LCD device, comprising the following steps:

(a) receiving a plurality of image data based on a data CLK signal;

(b) providing a first CLK signal and a second CLK signal to a plurality of source drivers by a timing controller, wherein a frequency of the first CLK signal and a frequency of the second CLK signal are smaller than a frequency of the data CLK signal, a phase of the first CLK signal is different from a phase of the second CLK signal, wherein a phase difference between the first CLK signal and the second CLK signal is less than 180 degrees; and (c) the timing controller transmitting a plurality of first image data to the plurality of source drivers based on the first CLK signal, and the timing controller transmitting a plurality of second image data to the plurality of source drivers based on the second CLK signal.

2. The method as claimed in claim 1, wherein in step (c), the timing controller transmits a plurality of third image data to the plurality of source drivers based on the first CLK signal, a phase of the plurality of first image data is different from a phase of the plurality of third image data.

3. The method as claimed in claim 1, wherein in step (c), the timing controller transmits a plurality of fourth image data to the plurality of source drivers based on the second CLK signal, a phase of the plurality of second image data is different from a phase of the plurality of fourth image data.

4. The method as claimed in claim 1, wherein in step (b), the timing controller further provides a third CLK signal and a fourth CLK signal, a frequency of the third CLK signal and a frequency of the fourth CLK signal are smaller than the frequency of the data CLK signal, and the phase of the first CLK signal, a phase of the second CLK signal, a phase of the third CLK signal, and a phase of the fourth CLK signal are different from each other.

5. The method as claimed in claim 4, wherein in step (c), the timing controller transmits a plurality of fifth image data based on the third CLK signal.

6. The method as claimed in claim 5, wherein in step (c), the timing controller transmits a plurality of sixth image data based on the fourth CLK signal.

7. A timing controller adapting for an LCD panel module, electrically connected with a plurality of source drivers by a point-to-point transistor transistor logic interface, comprising:

a receiving unit, receiving a plurality of image data based on a data CLK signal;

a data processing logic unit, electrically connected with the receiving unit and the plurality of source drivers; and a multi-phase CLK signal generating unit, electrically connected with the receiving unit and the data processing logic unit, wherein the multi-phase CLK signal generating unit provides a first CLK signal and a second CLK signal, a frequency of the first CLK signal and a frequency of the second CLK signal are smaller than a frequency of the data CLK signal, and the phase of the first CLK signal is different from the phase of the second CLK signal, wherein a phase difference between the first CLK signal and the second CLK signal is less than 180 degrees;

wherein the data processing logic unit transmits a plurality of first image data to the plurality of source drivers based on the first CLK signal, and the data processing logic unit transmits a plurality of second image data to the plurality of source drivers based on the second CLK signal.

8. The timing controller as claimed in claim 7, wherein the data processing logic unit transmits a plurality of third image data to the plurality of source drivers based on the first CLK signal, the phase of the plurality of first image data is different from a phase of the plurality of third image data.

9. The timing controller as claimed in claim 7, wherein the data processing logic unit transmits a plurality of fourth image data to the plurality of source drivers based on the second CLK signal, the phase of the plurality of second image data is different from a phase of the plurality of fourth image data.

10. The timing controller as claimed in claim 7, wherein the multi-phase CLK signal generating unit further provides a third CLK signal and a fourth CLK signal, a frequency of the third CLK signal and a frequency of the fourth CLK signal are smaller than the frequency of the data CLK signal, and the phase of the first CLK signal, a phase of the second CLK signal, the phase of the third CLK signal, and a phase of the fourth CLK signal are different from each other.

11. The timing controller as claimed in claim 10, wherein the data processing logic unit transmits a plurality of fifth image data based on the third CLK signal, and the data processing logic unit transmits a plurality of sixth image data based on the fourth CLK signal.

12. The timing controller as claimed in claim 7, further comprises a data latch logic unit electrically connected with the receiving unit and the data processing logic unit, the plurality of image data received by the receiving unit is registered at the data latch logic unit.

13. The timing controller as claimed in claim 12, wherein the data latch logic unit is a memory unit.

14. The timing controller as claimed in claim 12, wherein the data latch logic unit is a latch register.

15. The timing controller as claimed in claim 12, wherein the data latch logic unit is a buffer unit.

16. The timing controller as claimed in claim 7, further comprises:

a spread spectrum CLK signal generating unit, electrically connected with the multi-phase CLK signal generating unit, and an internal oscillating CLK signal generating unit, electrically connected with the spread spectrum CLK signal generating unit;

wherein the data CLK signal is input to the spread spectrum CLK signal generating unit.

* * * * *